US006146708A

United States Patent [19]

Kamitani

[11] Patent Number: 6,146,708

[45] **Date of Patent: *Nov. 14, 2000**

[54] COATING METHOD AND APPARATUS

[75] Inventor: Kiyoshi Kamitani, Shizuoka, Japan

[73] Assignee: Fuji Photo Film Co., Ltd., Kanagawa, Japan

[ * ] Notice: This patent is subject to a terminal disclaimer.

[21] Appl. No.: 09/159,640

[22] Filed: Sep. 24, 1998

[30] Foreign Application Priority Data

Sep. 26, 1997 [JP] Japan ..... 9-262120

[51] Int. Cl.[7] ..... B05D 1/30

[52] U.S. Cl. ..... 427/420; 118/419; 118/325; 118/DIG. 4

[58] Field of Search ..... 118/DIG. 2, DIG. 4, 118/410, 325, 419; 427/420

[56] References Cited

U.S. PATENT DOCUMENTS 2,761,791 9/1956 Russell ..... 117/34
3,968,772 7/1976 Greiller ..... 118/DIG. 4
4,647,482 3/1987 Degrauwe et al. ..... 118/DIG. 4
5,725,665 3/1998 Yoppel et al. ..... 118/DIG. 4

FOREIGN PATENT DOCUMENTS 57-110364 7/1982 Japan .

*Primary Examiner*—Brenda A. Lamb
*Attorney, Agent, or Firm*—Sughrue, Mion, Zinn, Macpeak & Seas, PLLC

[57] ABSTRACT

Coating liquids are supplied to a coating hopper, and are extruded onto a slide surface of the coating hopper through slits. A pair of guide members are provided at both sides of the slide surface. Side faces of the guide members are positioned at both ends of a desired width of the coating liquids flowing of the slide surface to be applied on a traveling web. Consequently, the coating liquids that flow over the whole width of the slits are divided into the inside and the outside of the desired width by the guide members, and the divided coating liquids are extruded onto the slide surface. The coating liquids within the desired width flow down between the guide members and coat the web, whereas the coating liquids outside the desired width are collected through channels, which are formed in the guide members.

8 Claims, 7 Drawing Sheets

COATING METHOD AND APPARATUS

BACKGROUND OF THE INVENTION

1. Field of the Invention

The present invention relates generally to a coating method and apparatus, and more particularly to a coating method and apparatus for coating a continuously-traveling web with coating liquids flowing down a slide surface of a coating hopper in manufacturing photographic film, photographic printing paper, magnetic recording tape, adhesive tape, pressure sensitive paper, offset printing plates, batteries, and so forth.

2. Description of Related Art

A slide bead coating apparatus is an example of coating apparatuses for applying coating liquids on the surface of a continuously-traveling web. U.S. Pat. No. 2,761,791 of Russell discloses a multilayer slide bead coating apparatus. According to this apparatus, a plurality of coating liquids flowing down a slide surface form beads in a gap where the coating liquids meet the traveling web, and the coating liquids are applied to the surface of the web through the beads.

There is also a curtain coating apparatus that coats the surface of the web with coating liquids through laminar flows thereof, which are formed between a lip and the traveling web.

The above-mentioned coating apparatuses must regulate the width of the coating liquids flowing down the slide surface in order to coat the webs with different widths.

For example, Japanese Patent Provisional Publication No. 57-110364 discloses a coating apparatus that regulates the width of the coating liquids to a desired width with guide plates. This apparatus is provided with a pair of the guide plates on the slide surface at both sides in the width direction of the slide surface, and the guide plates extend from the base end to the front end of the slide surface. The pair of guide plates regulate the width of the coating liquid.

This conventional coating apparatus, however, must be stopped every time there is a change in the web width, and coating hoppers must be changed according to the web widths.

To regulate the width of the coating liquids without changing the coating hoppers in a conventional coating apparatus shown in FIG. 11, the positions of the guide plates 103, which are provided on the slide surface 102, are changed so that the width of the coating liquids is regulated to a desired width $W_2$ in conformity with the web width. In addition, pocket stoppers 106 and spacers 107 must be inserted into manifolds 104 and slits 105, respectively, so that both ends of the manifolds 104 and the slits 105 are positioned at both ends of the desired width $W_2$.

Moreover, since there are changes in the capacities of the manifolds 104 and the slits 105 resulting from the insertion of the pocket stoppers 106 and the spacers 107, it is necessary to change the amount of the coating liquids supplied to the manifolds 104 according to the capacity in order to achieve a desired coating amount.

Hence, a time loss resulting from the stop in the coating operation, the changes in conditions, etc. significantly lowers the working efficiency, and it is necessary to provide the coating hoppers 101, the pocket stoppers 106, the spacers 107, etc. in the same number as the widths of the webs.

Furthermore, the above-mentioned coating apparatuses cannot coat the web satisfactorily if the web takes a winding course, because the guide plates 103 are fixed. To apply the coating liquids on the web that is taking a winding course in the conventional coating apparatus, there is no other way but to use an excessively wide web to leave uncoated areas with proper widths at both edge regions of the web. The edge regions of the web must be cut off after the coating, which drops the yield.

SUMMARY OF THE INVENTION

The present invention has been developed in view of the above-described circumstances, and has as its object the provision of the coating method and apparatus that eliminates the necessity for stopping the coating apparatus and the necessity for changing the amount of coating liquids supplied to the coating hopper when there is a change in the web width.

To achieve the above-mentioned object, the present invention is directed to a coating method comprising the steps of: supplying at least one coating liquid into a coating hopper; extruding the coating liquid onto a slide surface of the coating hopper through a substantially whole width of a slit of the coating hopper to cause the coating liquid to flow on the slide surface while regulating a width of the coating liquid flowing on the slide surface to a desired width with a pair of guide members arranged at both sides of the slide surface; coating a traveling web with the coating liquid flowing inside the desired width regulated with the guide members; and collecting the coating liquid flowing outside the desired width.

To achieve the above-mentioned object, the present invention is also directed to a coating apparatus comprising: a coating hopper having a slide surface and at least one slit, at least one coating liquid being supplied into the coating hopper, then being extruded onto the slide surface through the slit, then flowing on the slide surface, and then being applied on a traveling web; and a pair of guide members for regulating a width of the coating liquid applied on the web to a desired width, the guide members being arranged at both sides of the slide surface; wherein at least one of the guide members comprises: a guide plate for dividing the slide surface into the inside and the outside of the desired width, the guide plate regulating a width of the coating liquid flowing on the slide surface to be applied on the web; a partition for dividing the slit into the inside and the outside of the desired width, the partition projecting from the bottom of the guide plate and being slidably inserted into the slit; and a channel for collecting the coating liquid extruded outside the desired width.

According to the present invention, the pair of guide members are provided at both sides of the slide surface. Side faces of the guide members are positioned at both ends of the desired width of the coating liquids flowing on the slide surface to be applied on the web. Consequently, the coating liquids that flow over the substantially whole width of the slits are divided into the inside and the outside of the desired width by the partitions of the guide members, and the divided coating liquids are extruded onto the slide surface. The coating liquids within the desired width flow down between the guide members and coat the web, whereas the coating liquids outside the desired width are collected through channels, which are formed in the guide members.

Thus, the width of the coating liquids can be regulated only by sliding the guide members provided at both sides of the slide surface while the partitions are functioning as guides. When a change in the web width requires a change in the regulated width of the coating liquids, there is no necessity for stopping the coating apparatus and changing the amount of the coating liquids supplied to the coating hopper.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
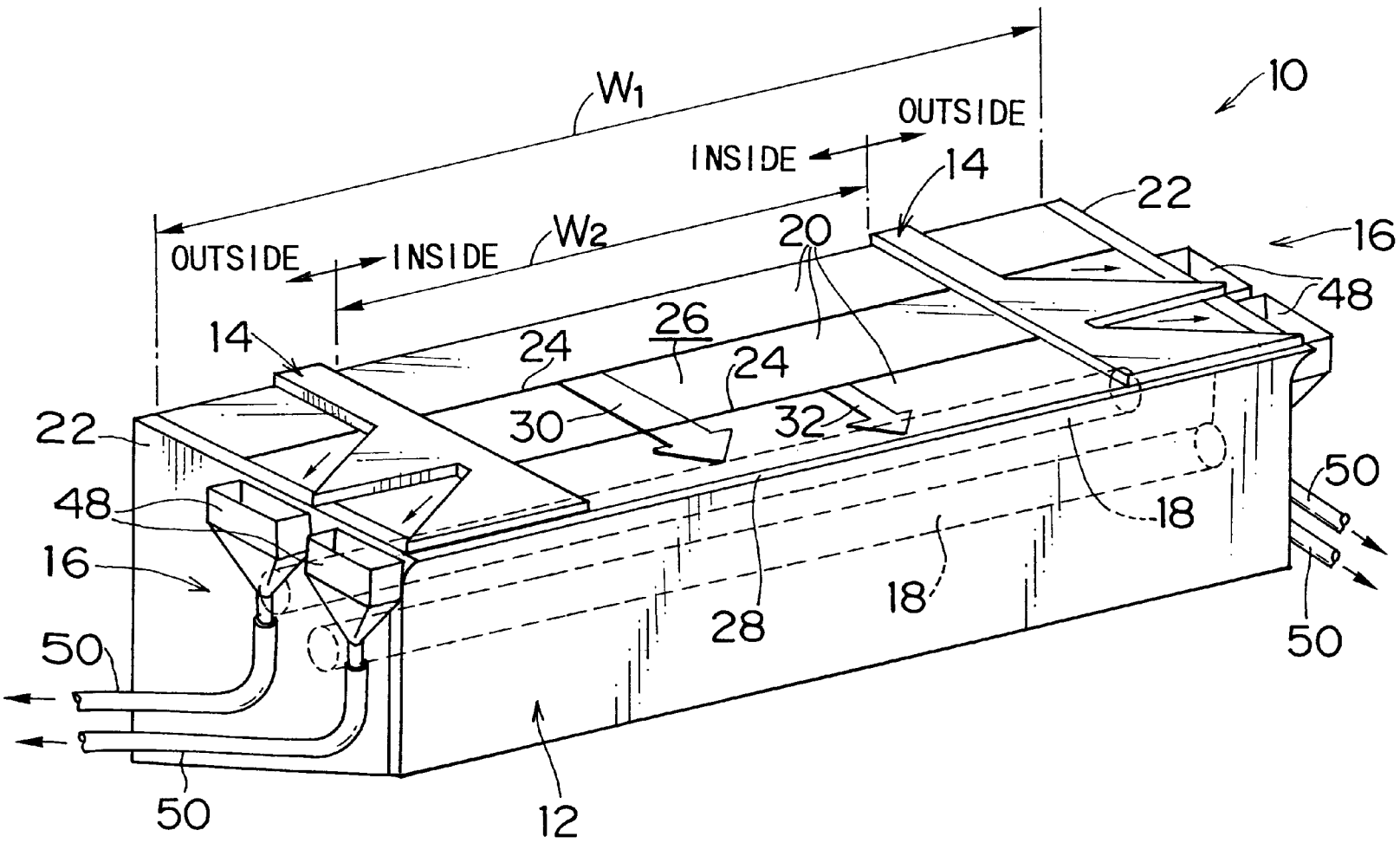
FIG. 1 is a perspective view of assistance in explaining the first embodiment of the coating apparatus according to the present invention.
Figure 2:
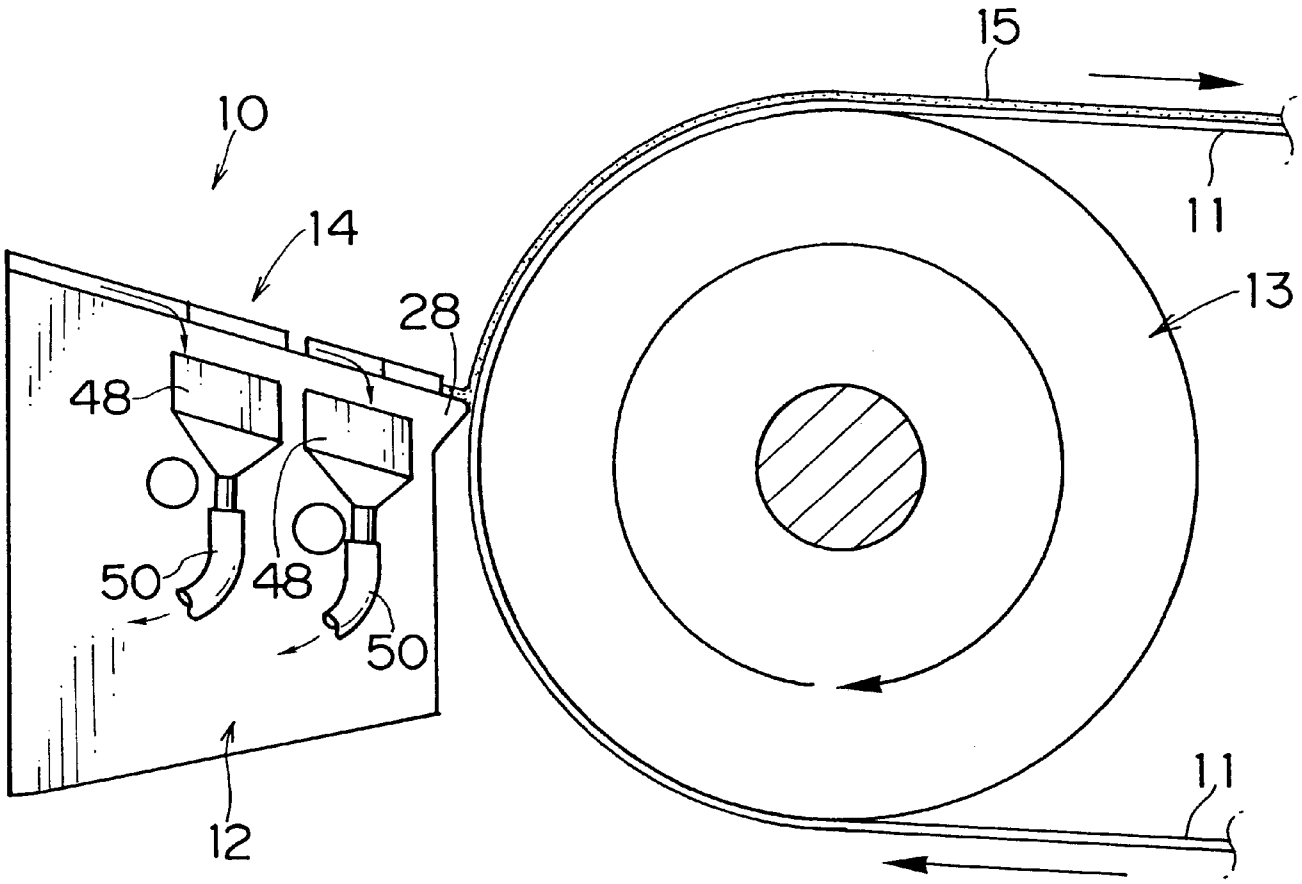
FIG. 2 is a side view illustrating the coating apparatus in FIG. 1, which is performing the slide bead coating.

FIG. 1 is a perspective view illustrating the first embodiment of the coating apparatus according to the present invention, which performs the slide bead coating. FIG. 2 is a side view illustrating the state wherein the coating apparatus in FIG. 1 is performing the slide bead coating.

As shown in FIGS. 1 and 2, the coating apparatus consists of a body 10, and a feeding member such as a backup roller 13 (see FIG. 2) that feeds a web 11.

The body 10 of the coating apparatus comprises a coating hopper 12, guide members 14, and collecting devices 16. A plurality (e.g., two) of coating liquids are supplied from coating liquid tanks (not illustrated) to manifolds 18 in the coating hopper 12 through supply lines (not illustrated). The body 10 in FIG. 1 supplies the coating liquids from one sides of each of the manifolds, and coats the web with the coating liquids in two layers.

The coating hopper 12 is constructed in such a manner that a plurality of die blocks 20 and a pair of side plates 22 are put together to thereby form channels for the coating liquids 15 that flow from the manifolds 18 onto a slide surface 26 at the top of the coating hopper 12 through slits 24. The coating liquids 15 are supplied to the ends of the manifolds 18, and they are extended in the manifolds 18. Then, the coating liquids 15 are extruded onto the slide surface 26 through the slits 24. The extruded coating liquids 15 flow down the slide surface 26 in the directions indicated with arrows 30 & 32 to reach a lip 28 at the bottom end of the slide surface 26. The coating liquids 15 do not mix with one another, and they become a laminar flow with multiple layers. Then, the coating liquids 15 form a bead between the lip 28 and the surface of the web 11. The coating liquids 15 are applied on the surface of the web 11 through the bead.

Figure 3:
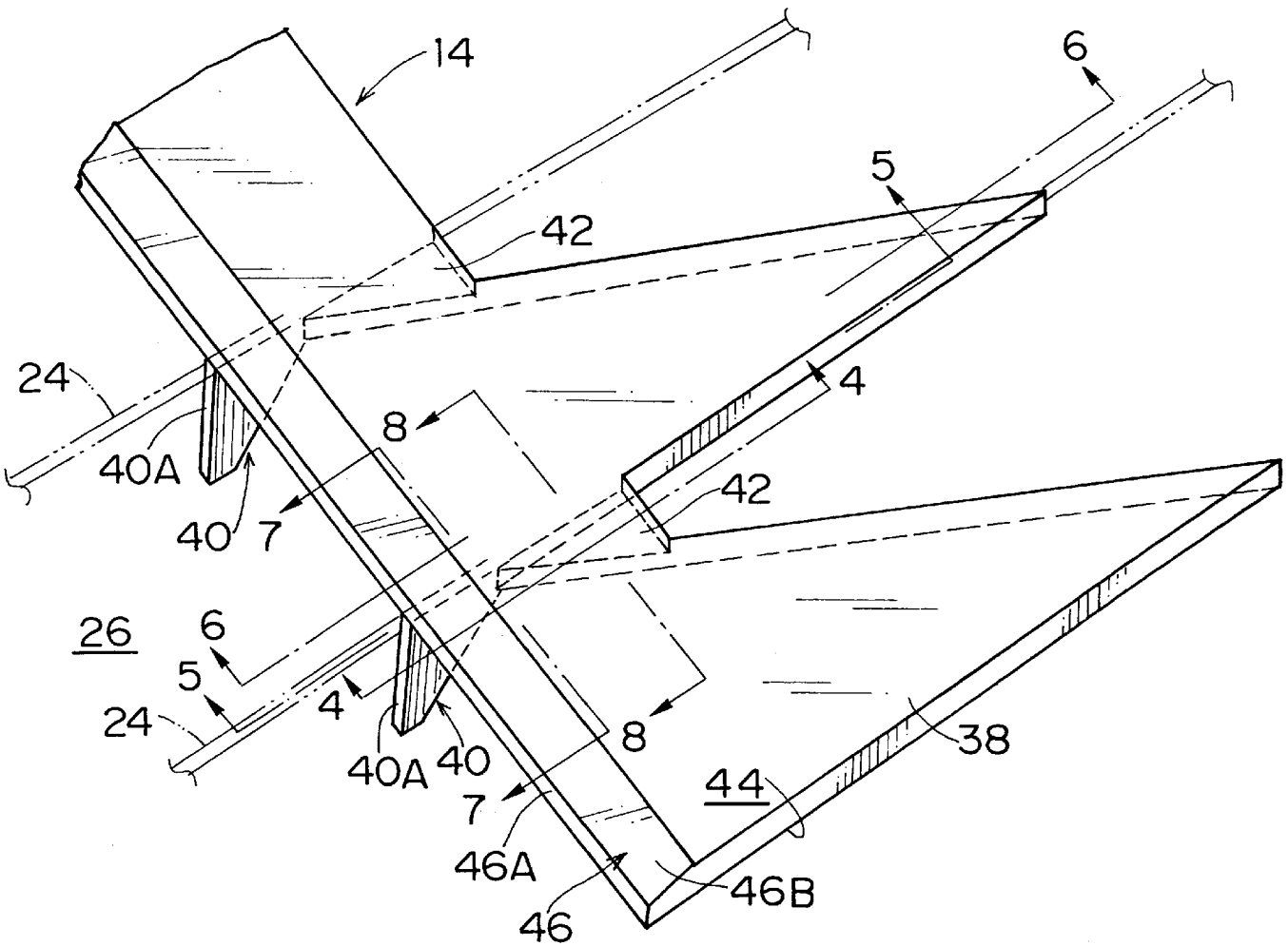
FIG. 3 is a view of assistance in explaining the structure of guide members of the coating apparatus according to the present invention.
Figure 4:
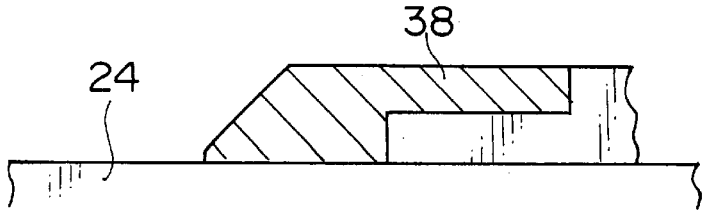
FIG. 4 is a sectional view taken along line 4—4 of FIG. 3.
Figure 5:
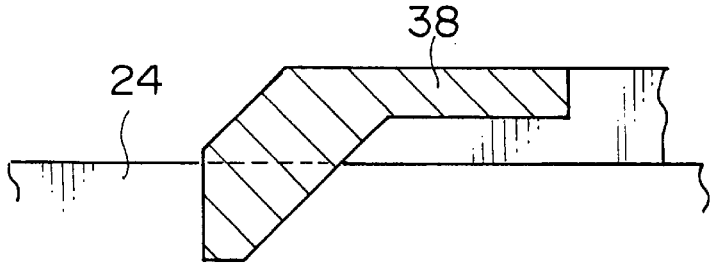
FIG. 5 is a sectional view taken along line 5—5 of FIG. 3.
Figure 6:
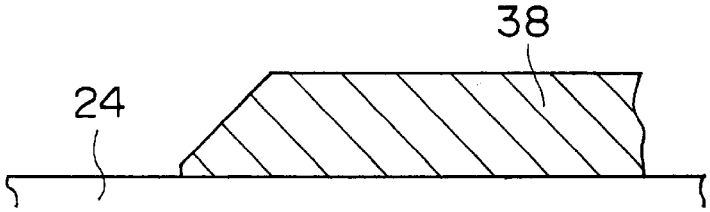
FIG. 6 is a sectional view taken along line 6—6 of FIG. 3.
Figure 7:
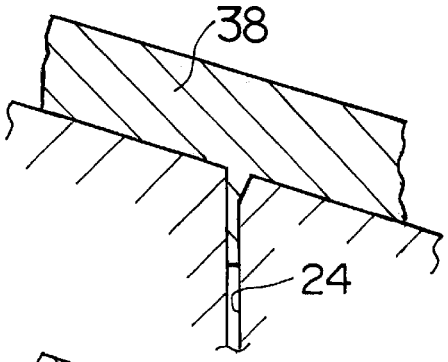
FIG. 7 is a sectional view taken along line 7—7 of FIG. 3.
Figure 8:
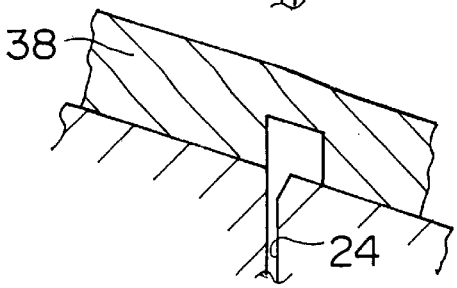
FIG. 8 is a sectional view taken along line 8—8 of FIG. 3.

As shown in FIG. 3, the guide member 14 comprises a guide plate 38, partitions 40 and channels 42 for the coating liquids 15. The partitions 40 and the channels 42 are the same in number as the slits 24.

The guide plate 38 has a flat bottom surface 44, which is in contact with the slide surface 26, and a side face 46, which is parallel with a direction in which the coating liquids 15 flow down. The side face 46 has a vertical surface 46A, which is substantially vertical to the slide surface 26, and a slant surface 46B slanting to the outside with respect to the slide surface 26. The vertical plane 46A regulates the width of the coating liquids 15 flowing down the slide surface 26.

The partitions 40 project from the guide plate 38 and are slidably inserted into the slits 24. The partitions 40 are thin boards with such thickness as not to form gaps between the partitions 40 and the slits 24. The partitions 40 are substantially right triangles, and sides 40A of the partitions 40, which are substantially vertical to the slide surface 26, are adjacent to the vertical plane 46A of the guide plate 38. The sides 40A and the vertical plane 46A of the guide plate 38 are positioned at each end of a desired width $W_2$ of the coating liquids 15. The partitions 40 divide the coating liquids 15, which rise in the slits 24 from the manifolds 18, into the inside and the outside of the desired width $W_2$. The partitions 40 are long to such a degree as to divide the coating liquids 15 into the inside and the outside of the desired width $W_2$.

The channels 42 are formed by cutting out the bottom of the guide plate 38 so that the excess coating liquids, which are outside of the desired width $W_2$, can flow to the sides of the slide surface 26. The channel 42 is provided for each slit 24 in order to prevent the excess coating liquids 15 from mixing with one another.

FIGS. 4, 5, 6, 7 and 8 are sectional views taken along lines 4—4, 5—5, 6—6, 7—7 and 8—8, respectively, in FIG. 3, showing a relation between the guide member 14 and the slits 24.

As shown in FIG. 1, the collecting devices 16 are provided at both sides of the coating hopper 12 for the channels 42 of the guide members 14. The collecting device 16 comprises a funnel 48 that receives the excess coating liquid 15 flowing through the channel 42, and a drain 50 by which the excess coating liquid 15 drains from the funnel 48.

A description will be given of the operation of the coating apparatus, which is constructed in the above-mentioned manner.

When a change in operations requires a change in the web width, the pair of guide members 14, which are provided at both sides of the slide surface 26, are slid in accordance with the desired width $W_2$ of the coating liquids 15 to be applied on the web 11 so that the vertical planes 46A of the guide plates 38 and the sides 40A of the partitions 40 can be positioned at both ends of the desired width $W_2$. At this time, the center of the interval between the guide members 14 is made to correspond to the center of the web width. Consequently, the coating liquids 15, which flow over the whole width $W_1$ of the slits 24, are divided into the inside and the outside of the desired width $W_2$ by the partitions 40, and the divided coating liquids 15 are extruded onto the slide surface 26. The inside coating liquids 15 are guided with the side faces 46 of the guide members 14 while flowing down the slide surface 26, and they are applied on the web 11 via the lip 28. On the other hand, the excess coating liquids 15 outside the desired width $W_2$ flow to the sides of the slide surface 26 through the channels 42, and they are collected into the funnels 48 of the collecting devices 16.

Consequently, when the web 11 changes in width, the width of the coating liquids 15 can be regulated without stopping the coating apparatus, and it is unnecessary to change the amount of the coating liquids 15 that are supplied to the manifolds 18. Unlike the conventional coating apparatus, there is no necessity for providing any pocket stoppers and spacers, which regulate the widths of the manifolds 18 and the slits 24.

Moreover, the excess coating liquids 15, which are extruded onto the slide surface 26 through the slits 24, are collected without mixing with one another, and the collected excess coating liquids 15 may be reused.

Furthermore, since the partitions 40 of the guide members 14 are slidably inserted into the slits 24, the partitions 40 can function as guides and the guide members 14 can be positioned easily and quickly at both ends of the desired width $W_2$ when the guide members 14 are slid.

Figure 9:
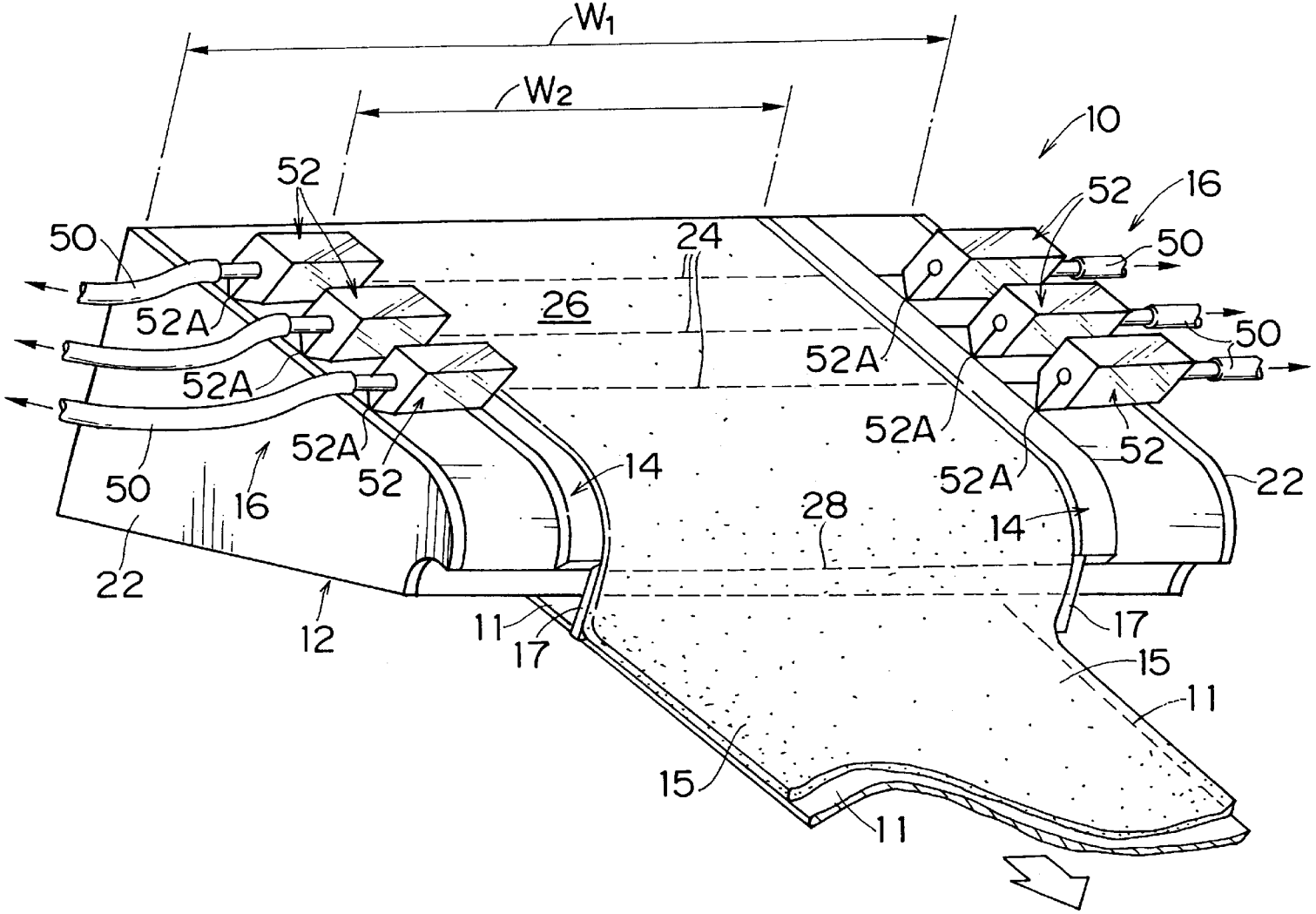
FIG. 9 is a perspective view illustrating the second embodiment of the coating apparatus according to the present invention.

FIG. 9 is a perspective view illustrating the second embodiment of the coating apparatus according to the present invention. Members similar to those of the first embodiment are denoted by the same reference numerals, and they will not be explained.

The coating apparatus in FIG. 9 performs a curtain coating, and has three slits 24 on the coating hopper 12. The structure of the guide member 14 according to the second embodiment is basically the same as in the first embodiment, but in the second embodiment, the guide member 14 is provided with suction collecting devices 52 that suck and collect the excess coating liquids 15 on the slide surface 26.

As shown in FIG. 9, the suction collecting devices 52 are provided on the slide surface 26 beside the three slits 24 outside the pair of guide members 14, which are provided at both sides of the slide surface 26. The guide members 14 and the suction collecting devices 52 are movable along the width of the coating hopper 12 in accordance with the width $W_2$ of the coating liquids 15 to be applied. A preferable minimum width of the coating liquids 15 is found by subtracting the widths of the guide members 14 and the suction collecting devices 52 from the width $W_1$ of the coating hopper 12. If the guide members 14 and the suction collecting devices 52 are positioned for the coating liquids 15 with a width of less than the preferable minimum width, it is possible that the suction collecting devices 52 cannot suck and collect part of the excess coating liquids 15 sufficiently. To coat the web 11 with a width of more than the preferable minimum width, the guide members 14 and the suction collecting devices 52 move toward the outside along the width of the coating hopper 12, and the suction collecting devices 52 are used over the side plates 22. Suction openings 52A of the suction collecting devices 52 are slits. The excess coating liquids 15 are sucked by the suction collecting devices 52 through the openings 52A, and are collected through the drains 50.

For performing the curtain coating, a pair of guide members 17 are arranged between the lip 28 of the coating hopper 12 and the web 11 in accordance with the width of the coating liquids 15 to be applied. The guide members 17 guide the curtain-shaped laminar flow of the coating liquids 15, which is formed between the lip 28 and the web 11, with the regulated width.

The second embodiment can achieve the same effects as the first embodiment.

Figure 10:
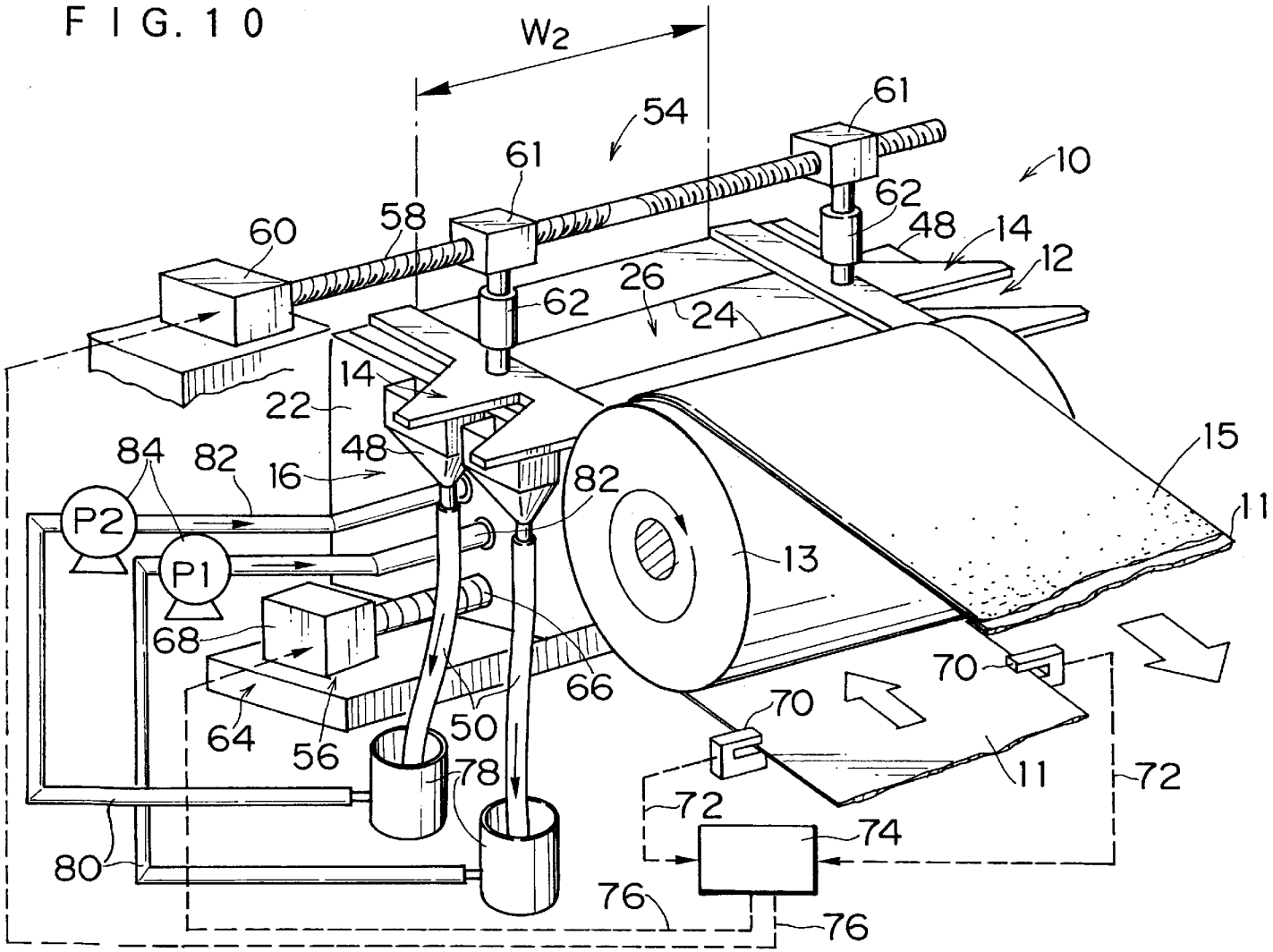
FIG. 10 is a perspective view illustrating the third embodiment of the coating apparatus according to the present invention.
Figure 11:
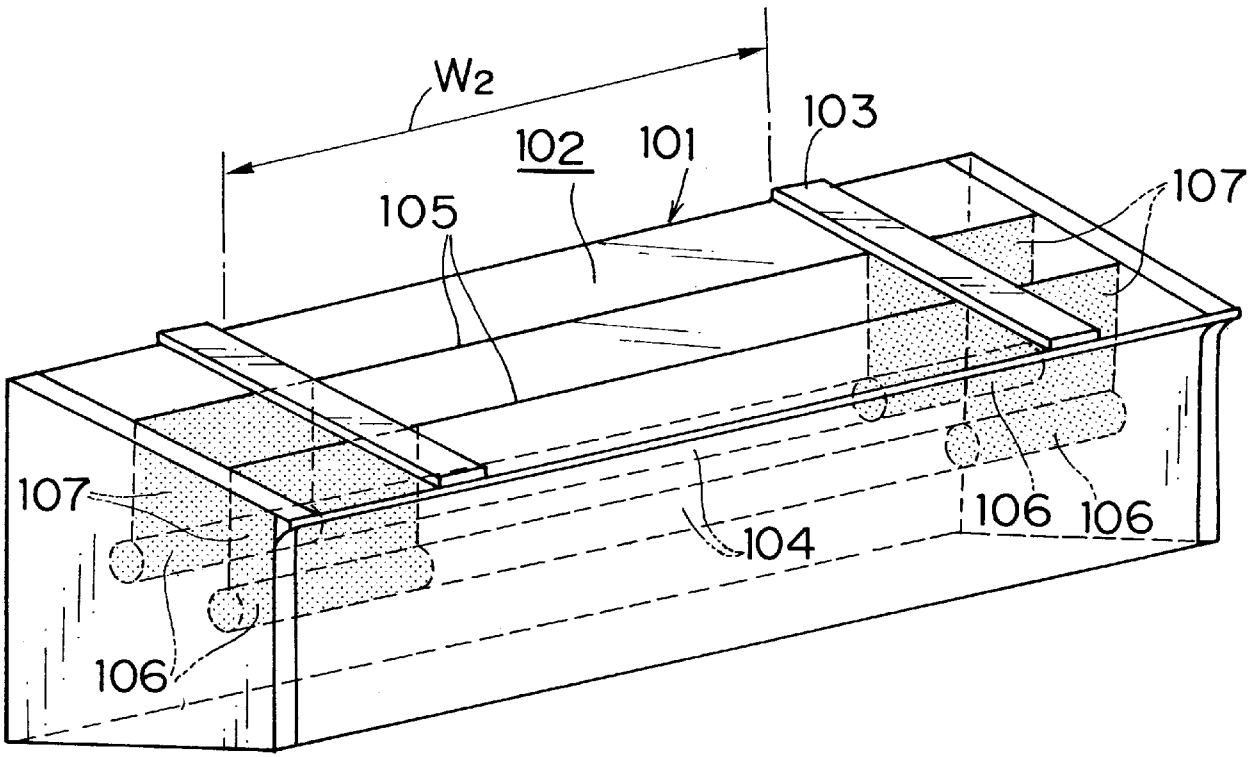
FIG. 11 PRIOR ART
FIG. 11 is a view of assistance in explaining a conventional coating apparatus.

FIG. 10 is a perspective view illustrating the third embodiment of the coating apparatus according to the present invention, which performs a bead coating. Two slits 24 are formed in the coating hopper 12. Members similar to those of the first and second embodiments are denoted by the same reference numerals, and they will not be explained.

In the third embodiment, there are provided a first slide device 54 that slides the guide members 14 along the slits 24 on the slide surface 26 so that the interval between the guide members 14 can correspond to the width of the web 11, and a second slide device 56 that slides the coating hopper 12 along the width of the web 11 to thereby adjust the positions of the web 11 and the coating hopper 12.

A description will be given of the first slide device 54. As shown in FIG. 10, a first feed screw 58 is arranged along the slits 24 above the slide surface 26 of the coating hopper 12. One end of the first feed screw 58 connects to a first motor 60, and the other end thereof is rotatably supported by a bearing (not illustrated). The first feed screw 58 is engaged with a pair of nut members 61, each of which supports the top of the guide member 14 through a connecting rod 62. Threaded directions of the first feed screw 58 at the first motor 60 side and at the bearing side of the central position of the first feed screw 58 are reverse. Running the first motor 60 slides the pair of guide members 14 in a direction to become closer to or farther from one another.

A description will be given of the second slide device 56. As shown in FIG. 10, the coating hopper 12 is slidably supported on a base 64. A slide mechanism (not illustrated) for the coating hopper 12 is constructed in such a way that a rail is provided on the base 64 to slide the coating hopper 12 with a linear bearing mechanism. A second feed screw 66 is arranged along the width of the web 11, and the body of the coating hopper 12 is provided with a threaded hole engaging with the second feed screw 66. One end of the second feed screw 66 connects to a second motor 68, which is arranged at one end of the base 64, and the other end of the second feed screw 66 is rotatably supported by a bearing (not illustrated). Running the second motor 68 slides the coating hopper 12 along the width of the web 11.

A pair of non-contact sensors 70 are provided so as to face both ends of the web 11, and the non-contact sensors 70 determine positions of both ends of the web 11. The determined results are input to a controller 74 through a signal cable 72. The controller 74 calculates a width of the web 11 according to the positions of both ends of the web 11 determined with the non-contact sensors 70, and the controller 74 calculates displacement of the web 11 along the width thereof according to the determined positions of both ends of the web 11. The controller 74 controls rotations of the first motor 60 and the second motor 68 through signal cables 76.

Coating liquids collected in the collecting devices 16 are separately returned through the drains 50 to coating liquid tanks 78. First ends of liquid supply pipes 80 connect to the coating liquid tanks 78, and the other ends thereof connect to liquid supply pipes 82 through liquid supply pumps 84. The liquid supply pipes 82 connect to the manifolds 18 through the side plate 22. The excess coating liquids collected in the coating liquid tanks 78 as well as the stored coating liquids are supplied to the manifolds 18.

According to the third embodiment which is constructed in the above-mentioned manner, when a change in operations requires a change in the web width, the non-contact sensors 70 determine the positions of both ends of the web 11, and the controller 74 calculates the web width in accordance with the determined results of the non-contact sensors 70. Then, the controller 74 drives the first motor 60 to slide the pair of guide members 14 to both ends of the desired width $W_2$ of the coating liquids in accordance with the determined web width. At this time, the controller 74 calculates the widthwise central position of the web 11 from the positions of both ends of the web 11 determined with the non-contact sensors 70, and drives the second motor 68 so that the center of the coating hopper 12 can correspond to that of the web 11.

Thus, it is possible to automatically regulate the width of the coating liquids without stopping the coating apparatus when there is a change in the web width. Moreover, there is no necessity for changing the amount of the coating liquids supplied to the manifolds 18, and hence, it is unnecessary to provide the pocket stoppers or the spacers, which regulate the widths of the manifolds 18 and the slits 24, unlike the conventional slide coating apparatus.

If the web 11 takes a winding course, in other words, if the widthwise central position of the web 11 is displaced, the non-contact sensors 70 determine the displacement of both ends of the web 11, and the controller 74 calculates the displacement amount of the web 11 from the determined results of the non-contact sensors 70. Then, the controller 74 drives the second motor 68 to slide the coating hopper 12 along the width of the web 11 in accordance with the displacement amount of the web 11.

In FIG. 10, both guide members 14 are moved so that the interval $W_2$ between the guide members 14 can correspond to the web width; however, the present invention is not restricted to this. One guide member 14 may be fixed and the other guide member 14 may be moved so that the interval $W_2$ can correspond to the web width. To follow the displacement of the web 11, the guide members 14 may be moved with the interval $W_2$ being constant in the state wherein the coating hopper 12 is fixed.

Thus, the coating apparatus according to the present invention can apply the coating liquids on the web 11 while following the displacement of the web 11, and there is no necessity for leaving uncoated areas with proper widths at both edge regions of the web 11 unlike the conventional slide coating apparatus. It is therefore unnecessary to cut off the edge regions of the web 11 after the coating, thus improving the yield. Moreover, even if the web 11 takes a winding course, it is possible to accurately control the widths of the uncoated areas on the web 11, or accurately coat the web 11 without leaving any uncoated areas.

Examples of the coating liquids used for the coating apparatus according to the present invention are: a coating liquid used for forming a sensitive emulsion layer, an undercoating layer, a protective layer, a back layer, etc. of a photosensitive material; a coating liquid used for forming a magnetic layer, an undercoating layer, a lubricant layer, a protection layer, a back layer, etc. of a magnetic recording material; and a coating liquid used for forming an adhesive layer, a coloring layer, a rust prevention layer, etc.

Examples of the webs used for the coating apparatus according to the present invention are paper, plastic film, metal, resin-coated paper, synthetic paper, etc. Examples of plastic materials used for the plastic film are: polyolefine such as polyethylene and polypropylene; vinylpolymer such as polyvinylacetate, polyvinylchloride and polystyrene; polyamide such as 6,6-nylon and 6-nylon; polyester such as polyethylene terephthalate and polyethylene-2,6-naphthalate; polycarbonate; and celluloseacetate such as cellulosetriacetate and cellulosediacetate. A typical example of the resin used for the resin coated paper is polyolefine such as polyethylene, but the present invention is not restricted to this. An example of a metal web is an aluminum web.

EXAMPLE

Example 1

The test for confirming the effects of the present invention was conducted by using the slide coating apparatus in FIG. 10.

First, the pair of guide members 14 were set in such a manner that the regulated width $W_2$ of the coating liquids is 400 mm in conformity with the web of 400 mm width. In this state, the slide coating apparatus was run, and the coated state of the web was observed. Next, the web width was changed from 400 mm to 300 mm without stopping the coating apparatus. To change the web width, the trailing end of the 400 mm wide web was spliced to the leading end of the 300 mm wide web.

The coating conditions were as follows:

1) the type of web: a hydrophilicized aluminum support
2) the width of a slit in the coating hopper (the liquid supply width): 600 mm
3) the coating speed: 20 m/min
4) the length of a coating dry line: 150 m
5) the type of a coating liquid for the lower layer of two layers: polyvinyl alcohol solution (20 cps, 32 dyne/cm, 1.024 g/cm$^3$)
6) the type of a coating liquid for the upper layer of two layers: polyvinyl alcohol solution (40 cps, 30 dyne/cm, 1.022 g/cm$^3$)
7) the coating amount of the lower layer: 20 cc/m$^2$
8) the coating amount of the upper layer: 20 cc/m$^2$ As a result, the 400 mm wide web was coated with two layers of the coating liquids over the whole width thereof without leaving any uncoated areas at the edge regions of the web.

When an area where the 400 mm wide web and the 300 mm wide web were spliced together came closer to the slide coating apparatus, the non-contact sensors 70 detected the spliced area. On detection of the spliced area, the first slide device 54 operated to slide the guide members 14 on the slide surface 26 along the slits 24, and the interval between the guide members 14 was automatically changed from 400 mm to 300 mm. It took only 15 seconds to change the width $W_2$ of the coating liquids, and the waste length of the web was only 5 m. According to the conventional coating apparatus, the production line was stopped in order to change the width of the coating liquids, and therefore, it took about 30 minutes to change the coating conditions and the waste length of the web was 150 m, which was equal to the length of the production line. The present invention can dramatically improve the manufacturing efficiency.

The 300 mm wide web was also coated with two layers of the coating liquids over the whole width thereof without leaving any uncoated areas at the edge regions of the web.

Example 2

The web was made to take a winding course with displacement along the width by 10 mm, and the slide coating apparatus performed the continuous coating under the conditions of the example 1. The second slide device 56 was operated to slide the coating hopper 12 in accordance with the displacement of the web.

As a result, the coating hopper 12 was moved to follow the displacement of the web of 10 mm, which enabled the continuous coating without leaving any uncoated areas at the edge regions of the web.

As set forth hereinabove, according to the coating method and apparatus of the present invention, the width of the coating liquids can be adjusted without stopping the coating apparatus when there is a change in the web width.

Moreover, there is no necessity for inserting the pocket stoppers and the spacers to the manifolds and the slits to regulate the widths of the manifolds and the slits, and hence, it is unnecessary to change the amount of the coating liquids supplied to the manifolds unlike the conventional coating apparatus.

Further, the excess coating liquids, which are extruded onto the slide surface through the slits, are collected without being mixed with one another, and therefore, the excess coating liquids can be reused.

Furthermore, since the partitions of the guide members are inserted into the slits to function as guides, the guide members can easily and quickly be positioned at both ends of the desired width.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A coating method comprising the steps of:

supplying at least one coating liquid into a coating hopper;

extruding the coating liquid onto a slide surface of the coating hopper through a substantially entire width of a slit of the coating hopper to cause the coating liquid to flow on the slide surface while regulating a width of the coating liquid flowing on the slide surface to a desired width with a pair of guide members arranged at both sides of the slide surface, at least one of the guide members being slidably adjustable;

coating a traveling web with the coating liquid flowing inside the desired width regulated with the guide members; and collecting the coating liquid flowing outside the desired width.

2. A coating apparatus comprising:

a coating hopper having a slide surface and at least one slit, at least one coating liquid being supplied into the coating hopper, then being extruded onto the slide surface through the slit, then flowing on the slide surface, and then being applied on a traveling web; and a pair of guide members for regulating a width of the coating liquid applied on the web to a desired width, the guide members being arranged at both sides of the slide surface;

wherein at least one of the guide members comprises:

a guide plate for dividing the slide surface into the inside and the outside of the desired width, the guide plate regulating a width of the coating liquid flowing on the slide surface to be applied on the web;

a partition for dividing the slit into the inside and the outside of the desired width, the partition projecting from the bottom of the guide plate and being slidably inserted into the slit; and a channel for collecting the coating liquid extruded outside the desired width.

3. The coating apparatus of claim 2, wherein the slide hopper has a plurality of the slits, and the guide member comprises a plurality of the partitions and a plurality of the channels, each of the plurality of slits being provided with the partition and the channel.

4. The coating apparatus of claim 2, further comprising:

web width determining means for determining a width of the web; and a slide mechanism for sliding at least one of the guide members in accordance with the determination of the web width determining means.

5. A coating apparatus comprising:

a coating hopper having a slide surface and at least one slit, at least one coating liquid being supplied into the coating hopper, then being extruded onto the slide surface through the slit, then flowing on the slide surface, and then being applied on a traveling web; and a pair of guide members for regulating a width of the coating liquid applied on the web to a desired width, the guide members being arranged at both sides of the slide surface;

wherein at least one of the guide members comprises:

a slidably adjustable guide plate for dividing the slide surface into the inside and the outside of the desired width, the guide plate, after being slidably adjusted to set a width of the coating liquid flowing on the slide surface, regulating the width of the coating liquid flowing on the slide surface and to be applied on the web; and a suction collecting device for sucking and collecting the coating liquid flowing outside of the guide plate on the slide surface.

6. The coating apparatus of claim 5, wherein the suction collecting device has a slot, the coating liquid being sucked through the slot, a length of the slot being substantially equal to or more than the width of the slide surface outside the guide plate.

7. The coating apparatus of claim 5, wherein the slide surface has a plurality of the slits, and the guide member comprises a plurality of the suction collecting devices, each of the plurality of slits being provided with the suction collecting device.

8. The coating apparatus of claim 5, further comprising:

web width determining mechanism which determines a width of the web; and a slide mechanism for sliding both at least one of the guide members and the suction collecting device in unity in accordance with the determination of the web width determining mechanism.

* * * * *